US005624071A

United States Patent [19]

Sosan

[11] Patent Number: 5,624,071

[45] Date of Patent: Apr. 29, 1997

[54] METHOD AND APPARATUS FOR RECEIVING PACKAGES

[76] Inventor: Folarin O. Sosan, 117 Varum St. NE. #6, Washington, D.C. 20011

[21] Appl. No.: 199,545

[22] Filed: Feb. 18, 1994

Related U.S. Application Data

[63] Continuation-in-part of Ser. No. 937,162, Aug. 31, 1992, abandoned.

[51] Int. Cl.[6] ..... B65D 91/00; E05B 73/00

[52] U.S. Cl. ..... 232/17; 232/1 R; 232/1 B; 232/20; 232/29; 70/14; 70/63; 70/234

[58] Field of Search ..... 232/1 R, 1 B, 232/1 C, 1 D, 1 E, 20, 22, 41 E, 42, 43.1, 43.2, 29; 70/285, 14, 63, 234, 38 C; 292/291; 200/284, 286, 288, 290

[56] References Cited

U.S. PATENT DOCUMENTS

| | | | |
|---|---|---|---|
| 934,230 | 9/1909 | Steinman | 232/42 |
| 1,089,985 | 3/1914 | Tehan | 232/41 E |
| 1,447,583 | 3/1923 | Wilkinson | 232/1 D |
| 1,500,251 | 7/1924 | Mangner | 232/42 |
| 2,017,786 | 10/1935 | Coverdale et al. | 232/41 E X |
| 3,996,775 | 12/1976 | Waldron | 70/234 |
| 4,080,020 | 3/1978 | Candelaria | 70/234 X |
| 4,667,491 | 5/1987 | Lokken et al. | 70/63 |
| 4,694,668 | 9/1987 | Ciletti et al. | 70/63 |
| 4,718,259 | 1/1988 | Appelbaum | 70/63 |
| 4,770,139 | 9/1988 | Nakai | 70/285 |
| 4,799,370 | 1/1989 | Cooper | 70/63 |
| 4,811,577 | 3/1989 | Webster et al. | 70/63 |
| 4,909,052 | 3/1990 | Hutwohl | 70/63 |
| 4,998,424 | 3/1991 | Lambert, II | 70/63 |
| 5,027,948 | 7/1991 | Forbes et al. | 323/1 E X |
| 5,150,834 | 9/1992 | Bourke | 232/1 C |
| 5,347,833 | 9/1994 | Branscum | 70/63 |

*Primary Examiner*—Michael J. Milano

[57] ABSTRACT

A method and apparatus for receiving packages in absentia using a receptacle which is temporarily attached to the door of an apartment or house. A second embodiment uses a bracket for securing a sack or chain to a door, which in combination with a lock can be used to receive packages. Both the receptacle and the bracket can only be removed from the door when it is first unlocked and opened. A combination lock permits the mail carrier to open and deposit packages in the receptacle or attach them to the bracket. The combination is provided to the mail carrier on the address label of the package, and is provided to the sender of the package by telephone or written correspondence. A sack or chain can also be used with the receptacle to receive packages which are larger than the receptacle. The method provides equal access to both U.S. mail carriers and private carriers.

27 Claims, 10 Drawing Sheets

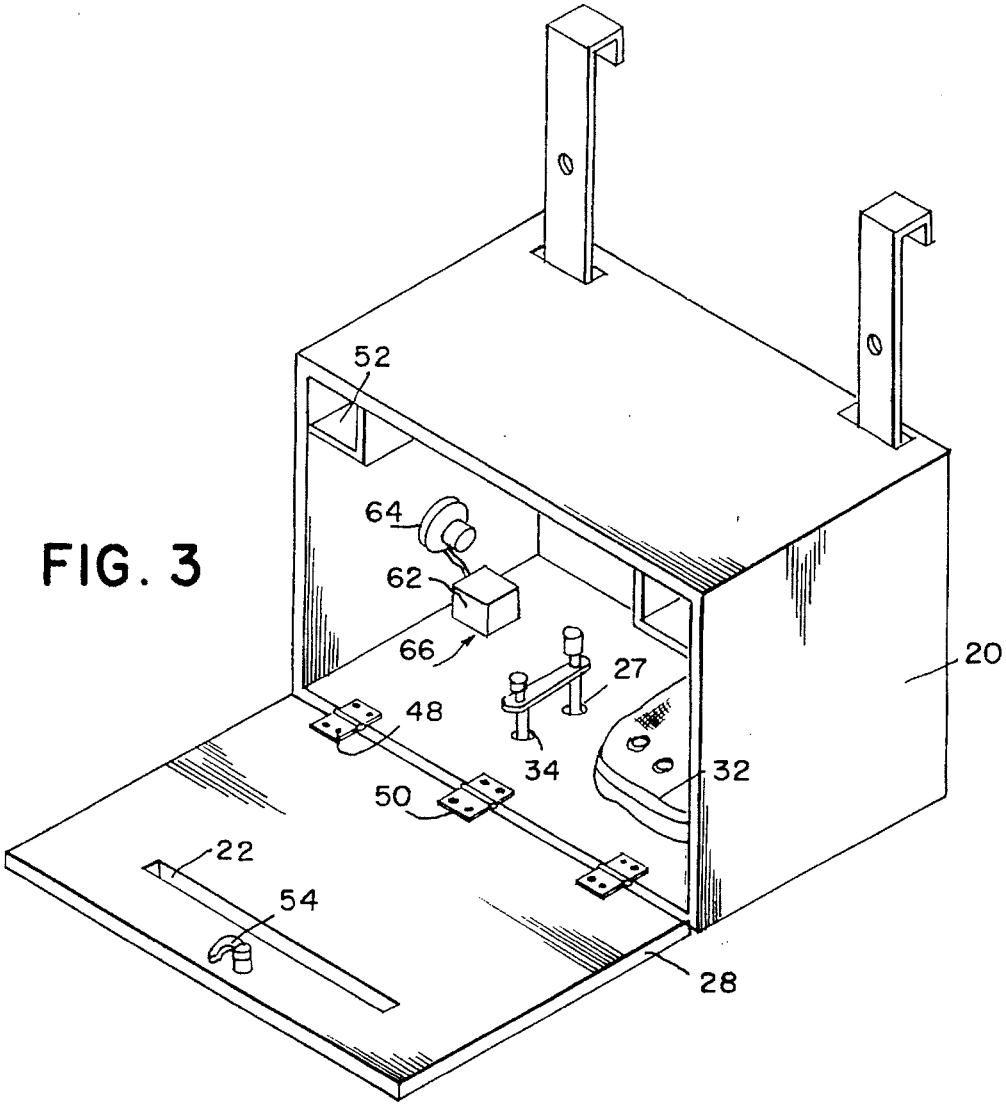
FIG. 3
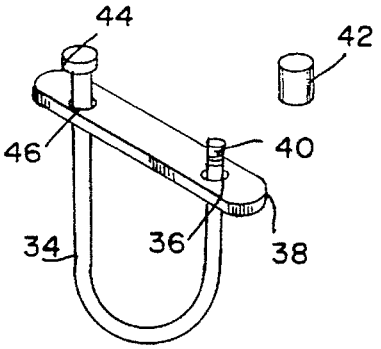
FIG. 4
FIG. 5
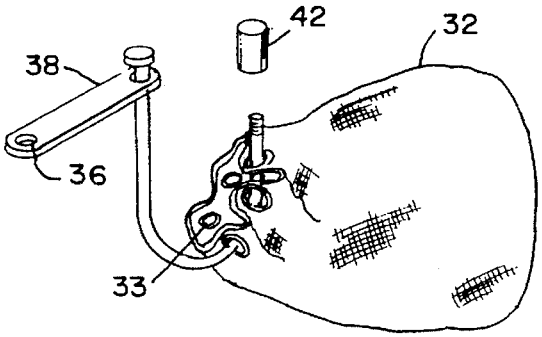

| FROM | | | | |
|---|---|---|---|---|
| ADDRESS | | | | |
| | | | | |
| TO | | | | |
| | | | | |
| COMBINATION | | | | |

DATE _____

MAIL CARRIER PLEASE

DEPOSIT PACKAGES ADDRESSED

TO _____

OR TO APARTMENT ___ IN THE

PACKAGE RECEIVING APPARATUS
ON THE DOOR OF APARTMENT___.

SIGNED,

_____

METHOD AND APPARATUS FOR RECEIVING PACKAGES

RELATED APPLICATION DATA

This application is a continuation-in-part of patent application Ser. No. 07/937,162 filed on Aug. 31, 1992 now abandoned.

FIELD OF THE INVENTION

This invention relates to an apparatus and method for receiving packages in absentia.

DESCRIPTION OF PRIOR ART

Letter boxes are usually too small to permit packages to be deposited in them. The usual procedure followed by the U.S. postal service and private mail carriers is to attempt to deposit a package to a resident of a home. When the resident is not in, and therefore cannot receive the package, a note is left on the door. The note typically will inform the addressee to pick up the package at a post office the next day, or in the case of private carriers, that another delivery attempt would be made the next day. The notes usually also state that the package would be returned to the sender after three delivery attempts. In many cases the addressee is necessarily away at work and would not normally be at home to receive packages. Costly arrangements then have to be made to be at home for the next delivery attempt which may be made any time during or up to one hour after a typical workday. Even when mail carriers leave a telephone number for the addressee to call and leave an alternative delivery address, the addressee is seldom able to influence the second delivery attempt because the mail carrier usually begins his route before the main office opens to receive telephone calls. This procedure leaves the addressee with very little margin for error and leads to expense and wasted time on the part of both carrier and addressee. Attempts to deliver packages to neighbors are uncertain at best and cause the addressee to depend on the honesty and timeliness of strangers as well as possible invasion of privacy. While some mailboxes exist, especially in rural areas, which are big enough to accommodate small packages, they are usually opened by key and are not accessible to the private mail carrier.

Ideally an addressee who expects to receive a package, or who receives notice of a package delivery attempt would temporarily deploy a large receptacle on his apartment door which would be accessible to both the U.S. mail carrier and private carriers such as United Parcel Service, or Federal Express but not to anyone else. The receptacle would be removably attached to the apartment door so that it can only be removed when the apartment door is first unlocked and opened. The size of the container would permit it to accommodate the majority of packages that are sent through the mail and it would be strong enough to resist the kind of minor tampering that may occasionally occur in an apartment building. While certain containers which are adapted for easy removal and attachment to doors have been disclosed in the prior art, they are designed primarily for newspapers. U.S. Pat. No. 4,066,208 to Jones and U.S. Pat. No. 4,494,690 to Dupois are such. The containers are elongated and have a cross sectional area much smaller than their lengths. They also have restricted entry ports through which newspapers and small articles may be inserted but not removed. The size, shape, construction, and mechanisms of these receptacles preclude their use for containing the majority of small packages that are sent through the mail. They in effect constitute mail boxes which are specially adapted for the insertion and safe keeping of newspapers. They are not suitable for the receipt of most small packages, or of medium sized and large packages. Other receptacles have been made to be temporarily attached to doors. U.S. Pat. No. 3,934,434 to Law discloses a key safe with a combination lock which can be attached to a door. The key safe is designed to separate when unlocked, into an upper attachment means and a main lower body. By its design, operation and small size it is not suitable for use as a package receptacle. Similarly, U.S. Pat. No. 4,703,850 to Walker discloses a receptacle for the temporary storage of shoes in a hotel. The receptacle is opened by key, attaches to the top of the door, which substantially forms a portion of the backwall of the receptacle. By its design, limited size, and method of use, the receptacle is unsuited for receiving large packages and is not available to mail carriers. U.S. Pat. No. 1,351,388 to Kabaci discloses a locking device for closing the mouth of a mailbag. The lock utilizes a loop which threads into eyelets in the sack and can be used as a handle for carrying the sack. A key operated lock is attached to the loop and can be locked to prevent opening of the sack. While suitable as a means to lock sacks, the device is not useful for the delivery of packages as it is not attached to a surface where it is accessible to a mailcarrier, nor does the key operated lock offer access to a mail carrier. The device lacks both the features and a method to allow it to be used as anything other than a lock for a hand carried sack. U.S. Pat. No. 4,785,960 also discloses a locking tab for a mailbag or sack as well as an anchor which is used to suspend the sack from a mailbox. The mailbox having a slit to accommodate the strap. The sack has to be torn and the strap cut, by the authorized user in order to obtain access to its contents after articles have been deposited by a mailcarrier. It is thus not reusable. It also does not afford the authorized user any special security since the way an authorized user would open it is exactly the same way that an unauthorized user would. That way being to destroy the sack and strap. The device also requires altering a mailbox by cutting a slit in it for the strap which suspends the sack.

There is therefore a need for a mail carrier to be able to deposit articles in a secure reusable receptacle which only the carrier and the addressee can open. The receptacle apart from being accessible to the mailcarrier should also have a secure opening means which is easily transmitted to the carrier but which prevents opening by unauthorized persons, and preferably which permits multiple deliveries without requiring supervision by the addressee.

SUMMARY OF THE INVENTION

The present invention provides a large boxlike receptacle with a hinged door along the front of the receptacle. The size of the receptacle and its door are such that the receptacle can accommodate most of the small and medium sized packages that are sent through the mail. The container is deployed by means of two supporting brackets which extend upwards from the body of the receptacle and end in two downward facing "U" shaped channels which can be slipped over the top of an open door. The brackets are flattened and thin enough that they do not prevent the apartment door from being shut but fit in-between the top of the door and door frame. The container would be deployed on the outside of the door with its ends hooking over the top of the door and onto the other side of the door. The door of the receptacle has a lock which can be opened by a key, or may have a recodable combination lock which can only be opened by the correct combination. A preferred embodiment features a lock that can be opened by key or combination. Such locks which provide both a combination opening means and a key by-pass are available commercially from such companies as the Master Lock Company in Milwaukee, Wis. A handle which has to be twisted to open the door after the lock has been opened, connects to the locking mechanism and is above a slot in the door which is intended to facilitate the deposit of newspapers, magazines and similar articles. A flexible containment means such as a sack, chain, cable, or natural or synthetic fibre can be used to secure packages externally of the receptacle. A sack which has holes in the perimeter of its single opening can be threaded unto a "J" shaped member which is suspended from the underside of the receptacle. The sack is suspended from the "J" shaped member by threading the member through the holes in the periphery of its opening. The "J" shaped member is suspended from the underside of the receptacle by inserting it through two small holes in the bottom of the receptacle such that the vertical legs of the "J" shaped member can slide up and down and the shorter end of the "J" shaped member can be lowered and extended outside the receptacle, or raised up into the receptacle where a crossbar which is secured to the end of the longer leg of the "J" shaped member can be attached to the shorter end and thus secure the sack from removal from the"J" member. The cross bar which would be on the inside of the receptacle connecting the ends of the "J" shaped member would also prevent the member from being removed from the receptacle without first opening the receptacle. The sack may be folded and stored in the receptacle until a package is received which is too big to fit into the receptacle. The package can then be deposited into the sack which is closed and secured unto the "J" shaped member which suspends it from the bottom of the receptacle. Most sacks have an opening along one width which is shorter than the length. A modification could employ a sack which has an opening along the entire length of the sack and may incorporate a zipper closing means. Such a sack would accommodate objects of comparable dimensions to the sack. The sack may also be lined with cables, chain, or to other tough substance to protect its contents from tampering, such as someone cutting the sack open. One embodiment of the invention shows how a package which is larger than the receptacle may be secured by means of a chain and padlock and attached to the "J" shaped member of the receptacle. A flexible containment means such as a cable, or fiber rope, natural or synthetic in nature may be substituted for the chain. The apparatus is thus able to receive packages of all sizes and shapes from small to medium sized ones which can fit inside the receptacle, to packages which are much larger than the receptacle.

Another embodiment of the invention shows the package receiving apparatus with the built-in lock replaced by a padlock and hasp. All the features of the invention can be retained by using a combination padlock that has a key by-pass. The use of either a combination padlock or a key operated padlock is also possible. Recodable combination padlocks are manufactured by such companies as the Master Lock company of Milwaukee, Wis., and Prestolock of Garfield, N.J. Such locks would allow a simpler less expensive embodiment of the invention. The ability to change the combination periodically is a security measure to protect the contents of the receptacle or containment means.

The "J" shaped member of the receptacle may also be attached directly to the door of a house or apartment by means of a bracket portion which fits over an edge of the door and which secures the "J" shaped member or link to the door. A combination padlock can then be used in cooperation with the member to attach and secure a sack, chain, or other containment means for securing packages, to the door. This would eliminate the need to have the receptacle on the door if the occupant knows that it will not accommodate the expected package or wishes to avoid the additional expense of a receptacle. Some combination padlocks incorporate a flexible cable as a connecting link instead of a generally "J" rigid pivoted link. Such padlocks may be used by threading the cable through a bracket which secures the lock to the door and further through the holes in the periphery of the opening of a sack, or around a package, or through the links of a chain which secures a package. The combination locking member may also be attached anywhere on the door including the knob of the door. A chain for example may be attached around the doorknob and to an article in such a way that the chain cannot be removed from the knob or from the package. Many doorknobs have a handle portion which is circular and wider than the cylindrical stem. Wrapping a length of chain around the narrow stem and securing a padlock through links of the length of chain so that the length of chain forms a loop which cannot be slid over the wider handle portion, will effectively secure the length of chain to the handle. A bracket which is secured to the door handle and which is adapted to receive a combination locking member or other kind of lock may also be used to receive articles. The bracket may be adapted to receive and secure a flexible containment means such as a sack or a chain, or some other receptacle.

In use, a person who wishes to receive a package will provide the sender of the package, with the combination of the receptacle by telephone or by written correspondence. The sender can then write this combination on an address label along with the address and zip code. The Addressee will then deploy the receptacle on the door of his house or apartment until the package arrives. The mail carrier who delivers the package will be able to open the receptacle and deposit the package inside the receptacle, and relock the receptacle door. In addition or alternatively, the U.S. mail carrier can be provided with the key to the receptacle, possibly by making it the same key that opens the regular mailbox, or by leaving the key inside the regular mailbox. Packages which are larger than the receptacle or too irregularly shaped may be deposited by means of the sack or the chain. If the addressee was not expecting a package and received notice that a delivery attempt of a package had been made, and another scheduled the next day, the addressee would deploy the receptacle on his door the next day before going off to work. The addressee could leave the receptacle open in this case, and after delivery of the article the mailcarrier would close and lock it. Once a package is received, the addressee can remove the receptacle from the door. This allows the addressee to receive packages safely and reliably Without the cost and inconvenience of having to be at home when the package arrived. People who shop by mail, subscribe to book, record, video or magazine clubs, engage in mail order businesses, or otherwise receive articles by mail regularly, would greatly benefit from the invention. In addition the invention can be used for the temporary storage of mail. People who go on vacations and do not have the time to request an address change at the post office, or do not wish to have the post office hold their mail, can deploy the receptacle on their door, and if their regular mailbox is filled, mail can be deposited in the receptacle. An alarm which is responsive to excessive vibration can be placed inside the receptacle to protect it from tampering.

There are many ways to provide the mail carrier with the combination.

These include, using a telephone to transit the combination by voice or facsimile machine. Another way is to encode the combination into a barcode label and put the label on the package. The mailcarrier would decode by means of a barcode scanner and deliver the package. This method would protect the security of the receptacle if the package was misplaced. Another method is to encode the combination with number, letters, or a combination of both and depict the code on the address label. The mailcarrier would be provided with the algorithm that decodes the combination to enable him to obtain the combination and deliver the package. The combination could be transcribed and a transcript of the combination sent with the package so that it is available to the mailcarrier to use in delivering the package. Another method of providing the carrier with the combination is to retain it on a silicon chip or chips, and provide the chip to the carrier. An electronic combination lock can be used instead of a mechanical one. Another method of providing the carrier with the combination is to transmit it electromagnetically to the carrier. The carrier would employ a receiver which may be handheld or in his truck to receive the transmission and obtain the combination. Any method of reproducing the combination in perceptible form so that it is perceptible to humans or machines (e.g. a barcode scanner), and providing the carrier with a reproduction of the combination is suitable. This includes any method of disclosing the combination to the carrier including visually indicating the combination on the exterior of a package, writing it, encoding it in a barcode label or other code, faxing it, telephoning it, or transmitting electromagnetically.

Accordingly several objects and advantages of my invention are;

A method of securing an article to a door mounted within a door frame, the method comprising the steps of:

providing containment means for surrounding the article;

providing securing means for securing the containment means to the door, the securing means comprising receiving means for receiving the containment means and a combination lock for securing the containment means to the receiving means;

surrounding the article with the containment means; manipulating the containment means so as to position the containment means on the receiving means;

employing the combination lock to secure the containment means to the receiving means, whereby unauthorized removal of the article is prevented.

The method further comprising the steps of:

opening the door;

securing a bracket to the open door in such a manner that a first portion of the bracket overlies a first side of the door and a second portion of the bracket overlies a second side of the door;

closing the door so as to secure the bracket between the door and the door frame; wherein the securing means is integral with the bracket and the flexible containment means is secured to the bracket.

The method described above wherein the containment means is flexible.

An apparatus comprising;

flexible containment means for surrounding an article;

a bracket which includes retaining means for retaining the flexible containment means;

a door movable between an opened position and a closed position relative to a door frame;

means for removably securing the bracket to the door;

means for locking the door in the closed position;

means for preventing the removal of the bracket from the door when the door is in its closed condition; and securing means for securing the flexible containment means to the retaining means, wherein the securing means comprises a combination lock;

An apparatus, comprising:

a door movable between an opened position and a closed position relative to a door frame;

a receptacle adapted to receive articles, the receptacle including a door portion which is movable between a first position where the door portion substantially covers an opening of the receptacle and a second position where the opening of the receptacle remains substantially uncovered, whereby when the door portion is in the second position, articles may be inserted through the opening and deposited within the receptacle;

means for removably securing the receptacle to the door;

means for locking the door in the closed position;

means for preventing the removal of the receptacle from the door when the door is in its closed condition; and receptacle locking means for selectively locking the door portion of the receptacle in the first position, whereby articles deposited within the receptacle may be secured therein, wherein the receptacle locking means comprises a combination lock with a key by-pass, whereby the receptacle may be opened either by a postal carrier having access to a key for the receptacle locking means or by an authorized individual having access to a combination for the receptacle locking means.

The receptacle could include a slot provided in a portion of the receptacle, whereby small articles may be inserted through the slot and deposited within the receptacle without moving the door portion of the receptacle to the second position.

The receptacle could also include flexible containment means for containing large articles externally of the receptacle; and securing means for securing the flexible containment means to the receptacle;

A method for insuring safe delivery and receipt of a package at an address comprising the steps of:

providing a combination lock retaining member in a vicinity of the address;

retaining a combination lock on the combination lock retaining member;

providing a containment means for receiving the package;

interconnecting a locking member of the combination lock with the containment means in such a manner that the locking member is effective to hold the containment means in a closed condition in which the containment means substantially surrounds the package;

locking the combination lock; and providing a package carrier with a combination to the combination lock;

wherein upon delivery, the package carrier performs the steps of:

unlocking the combination lock;

opening the containment means;

depositing the package within the containment means; closing the containment means; and relocking the combination lock so as to secure the package within the containment means, thereby preventing unauthorized removal of the package from the containment means;

wherein the step of providing the package carrier with the combination includes:

reproducing the combination in perceptible form and providing the carrier with a reproduction of the combination.

A method for insuring the safe delivery and receipt of packages at an occupant's address comprising the steps of:

a) employing means for installing a combination locking member in a secure fashion in the vicinity of the occupant's address; wherein, the combination locking member is provided with a generally J-shaped pivoted link adapted to form a closure in cooperation with the combination locking member;

b) attaching a containment means to said combination locking member; and, c) providing package carrier with the combination to said combination locking member so that the pivoted link can be partially disengaged from said combination locking member to allow the containment means to receive the package; and, d) re-engaging the pivoted link with the combination lock member to close the combination lock.

A method for insuring safe delivery and receipt of a package at an address comprising the steps of:

a) providing a combination lock retaining member in a vicinity of the address;

b) retaining a combination lock on the combination lock retaining member;

c) interconnecting an open locking member of the combination lock and a containment means for receiving the package in such a manner that the locking member is effective to hold the containment means in a closed condition in which the containment means substantially surrounds the package;

d) locking the combination lock; and c) providing a package carrier with a combination to the combination lock;

wherein upon delivery, the package carrier performs the steps of:

d) unlocking the combination lock;

e) opening the containment means;

f) depositing the package within the containment means;

g) closing the containment means; and h) relocking the combination lock so as to secure the package within the containment means, thereby preventing unauthorized removal of the package from the containment means;

wherein the step of providing the package carrier with the combination includes:

electromagnetically transmitting the combination to the package carrier.

The containment means may be rigid such as a plastic box, or other receptacle, or it could be flexible like a sack, chain, or cable. Further objects and advantages of my invention will become apparent from a consideration of the drawings and ensuing description of it.

BRIEF DESCRIPTION OF THE DRAWINGS

FIG. 3 is a perspective view of an open package receiving apparatus showing optional accessories inside.

FIG. 4 is a perspective view of a "J" shaped member and securing means.

FIG. 5 is a perspective of a sack secured by a "J" shaped member.

DETAILED DESCRIPTION OF PREFERRED EMBODIMENTS

Figure 1:
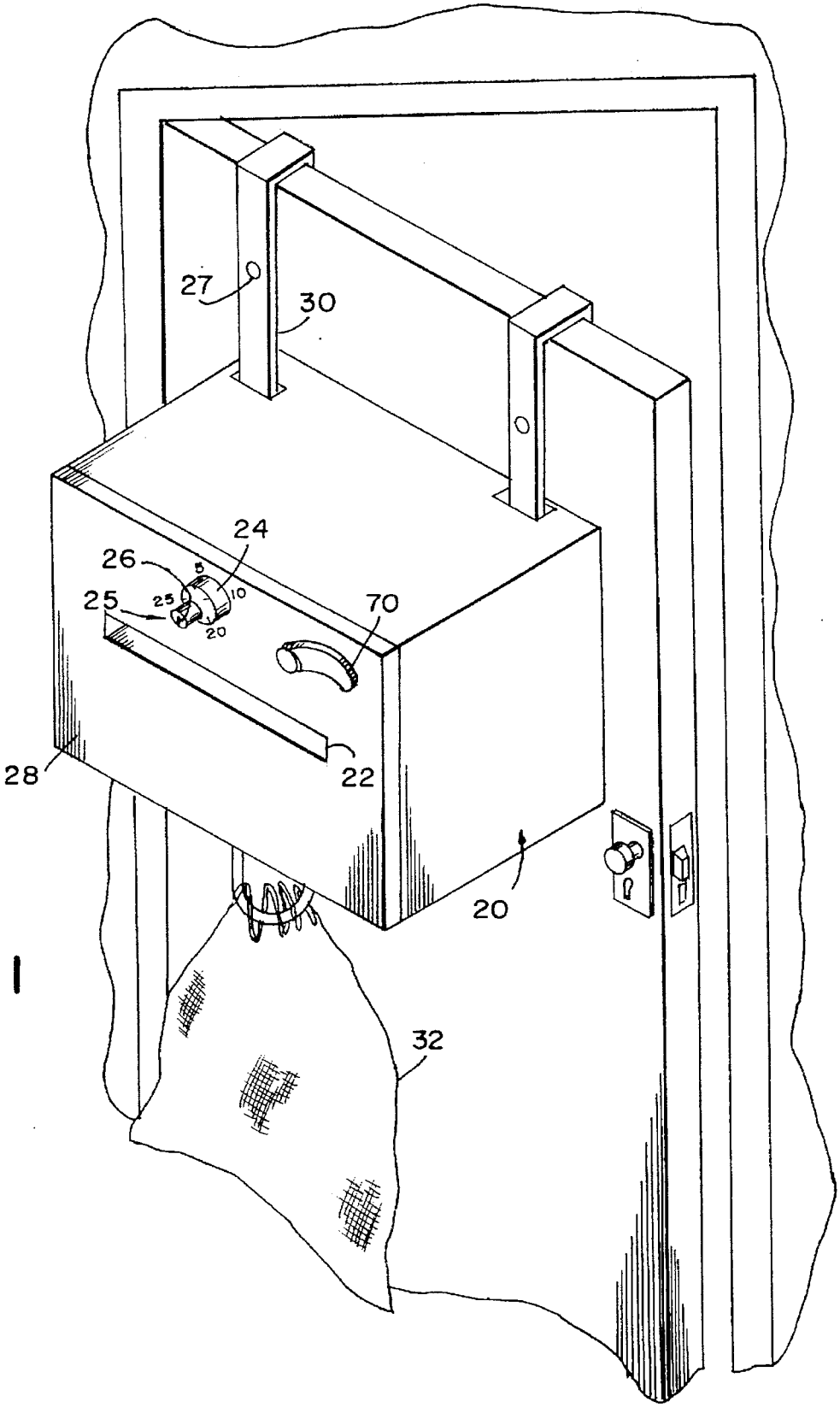
FIG. 1 is a perspective view of a package receiving apparatus made according to the present invention.

A body of a box-like receptacle 20 has a hinged door 28. As shown in FIG. 1 two brackets 30 with inverted "U" shaped ends extend from the back of the receptacle 20. The ends of the supporting brackets 30 slip over the top of an open door. The brackets 30 being made of thin sheet metal allow the door to be shut and locked without obstructing the door. Holes 27 in the brackets are employed to adjust the height at which at which the receptacle hangs on the door. A lock 25 incorporates a keyhole 26 and a code lock 24 which independently open the door 28. A handle 70 is attached to the door for holding the door and depending on the kind of locking mechanism used, may also serve to unlatch the door. A narrow slot 22 in the middle of the door 28 facilitates the deposit of letters, magazines, and newspapers without opening the door 28. A sack 32 hangs under the receptacle 20. The sack is generally larger than the receptacle 20 and therefore can accommodate objects which are too big to fit inside the receptacle 20.

Figure 2:
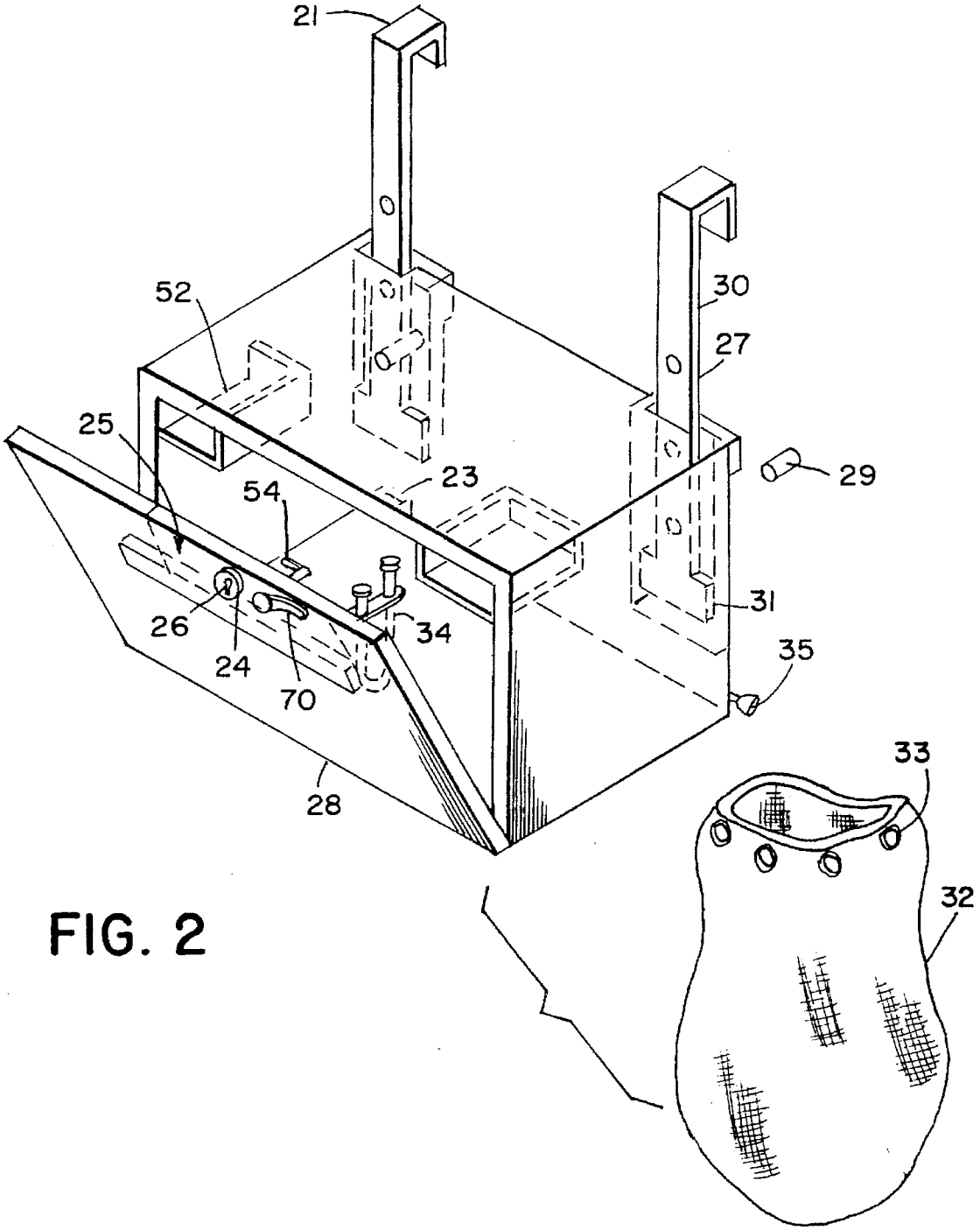
FIG. 2 is a perspective view of a package receiving apparatus showing the assembly of its major components.

As best shown in FIG. 2 with reference to FIGS. 4 and 5, the sack 32 is attached to and suspended from underneath the body of the receptacle 20 by a "J" shaped member 34. The "J" shaped member 34 passes through two small holes in the bottom of the receptacle such that the open end of the "J" shaped member 34 is inside the receptacle 20 and the curved portion is outside. FIGS. 4 and 5 show details of the "J" shaped member or link. After unthreading the threaded handle 42 from the shorter end of the "J" shaped member or link, the "J" shaped member 34 can be lowered by pushing it down or allowing it to fall, so that it is suspended from the receptacle 20 by its longer end and the shorter end is completely outside of the receptacle. It may also be raised by pulling it up so that both ends are inside the receptacle. When its shorter end is lowered outside the receptacle, the "J" shaped member 34 hangs from the receptacle like a hook. The sack 32 has holes 33 along the perimeter of its opening which are ringed with metal. Many sacks used by the post office or the military are of this construction. The metal rings prevent the holes in the sack from tearing. The sack can then be attached to the "J" shaped member 34 by threading the shorter end of the "J" shaped member 34 through the holes 33 in the sack 32 which is closed by this procedure. The "J" shaped member 34 can then be drawn back up into the receptacle 20 by pulling it up so that both of its open ends are inside the receptacle. The ends of the "J" shaped member 34 can then be secured inside the receptacle 20 by reattaching the crossbar 38 and threaded handle 42. As shown in this figure the height of the brackets 30 can be varied by inserting short dowel shaped rods 29 through any of a plurality of holes 27 in the brackets 30 and into holes in the back of the receptacle 20. By using different holes 27 in the brackets 30 of the receptacle 20, the receptacle can be made to hang above the lock of the apartment door to which it is attached to prevent it from interfering with the normal operation of the apartment door. Suction cups 35 at the rear of the receptacle attach the receptacle to the door at its lower end and prevent the receptacle from banging the door when it is opened or closed. Alternatively, strips of velcro attached to the receptacle and to the apartment door could be pressed together to secure the receptacle 20 to the apartment door in a similar way to the suction cups to prevent the receptacle from banging against the door. The lock 25 of the receptacle 20 includes a keyhole 26, and a combination lock 24 which may be recodable. A handle 70, and a locking tongue 54 may be made responsive to the actuation of the handle 70 depending on which locking mechanism is installed. Some locks with a combination and a key by-pass do not require a separate handle to operate the locking latch or cam. In the present embodiment, the handle 70 is prevented from moving the locking tongue 54 after the door 28 is closed. The door 28 can only be opened after the correct combination is entered into the lock 25, or the correct key is used to open the door through the keyhole 26. The locking tongue 54 engages a recess 23 in the body of the receptacle 20. This prevents the door 28 from opening until the locking tongue 54 is disengaged from the recess 23 by unlocking the lock 25 and twisting the handle 70. Corner shelves 52 in the receptacle 20 allow the user to leave authorization slips for the mail carriers One shelf could be labelled "U.S. mail" and the other "private carrier".

FIGS. 4 and 5 show details of the "J" shaped member 34. A wide flattened crossbar 38 is attached through a hole 46 at one end to the longer end of the "J" shaped member 34 and prevented from coming out of that end by a flatted stopper 44 on the end of the longer end of the "J" shaped member 34. The crossbar 38 also has a hole 36 at it's other end which slips over the threaded end 40 of the shorter end of the "J" shaped member 34. A cylindrical handle 42 with a threaded hole in it is then screwed onto the shorter end 40 of the "J" shaped member. The member is used as a receiving means for a flexible containment means such as a sack, chain, cable, or rope.

As shown in FIG. 3 after the door 28 is closed, the sack 32 is secured from removal from the receptacle 20 without first opening the door 28 of the receptacle. The holes 27 in the bottom of the receptacle through which the vertical legs of the "J" shaped member 34 pass through are Just wide enough to allow the legs of the member to pass through but will not allow tools to be inserted into the receptacle from the outside. The width of the crossbar 38 as it closes off the ends of the "J" shaped member also prevents access to the threaded handle 42 which holds it attached to the "J" shaped member. The floor of the receptacle can also be reinforced with a metal plate to prevent the "J" shaped member 34 from being pulled through the receptacle.

An optional alarm is shown inside the receptacle. The alarm has a battery powered control unit 62 and a speaker 64 and is sensitive to vibration. Excessive vibration caused by tampering could be made to set the alarm off, which would emit loud sounds from the speaker and discourage tampering with the receptacle. The door 28 is shown attached to the body of the receptacle 20 by means of hinges 50 and screws 48. The sack 32 is shown folded inside the interior of the receptacle 20. The "J" shaped member 34 is also shown inside the receptacle 20.

Figure 6:
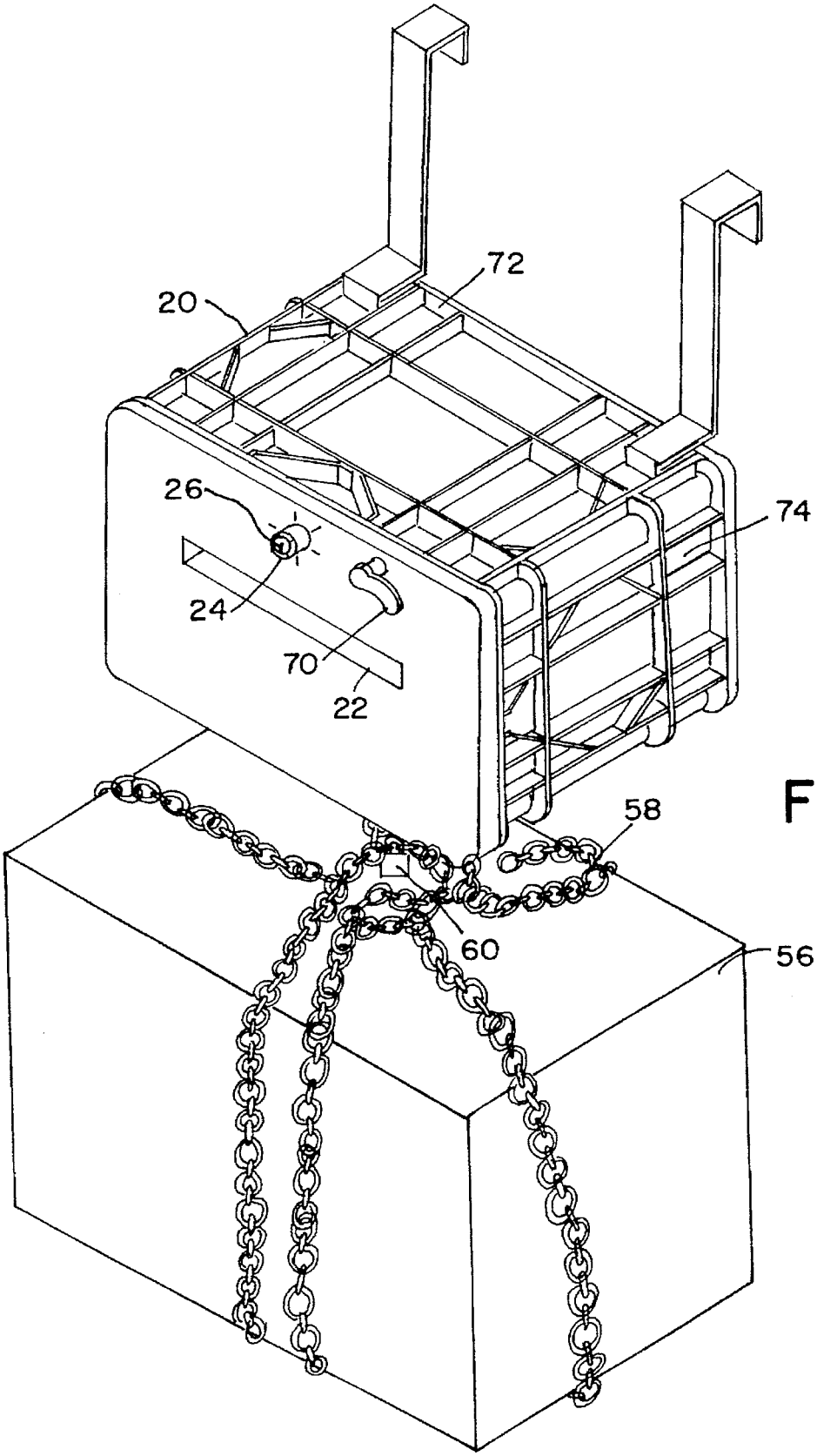
FIG. 6 is a perspective view of a large package secured to the package receiving apparatus with a chain and padlock.
Figure 7:
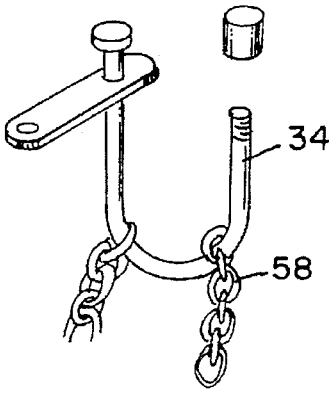
FIG. 7 is a perspective view of a "J" shaped member with securing means, and a chain.

FIG. 6 shows a preferred embodiment of the invention in which the receptacle is made of tough plastic similar to that used to make milk crates. Like milk crates, the body of the receptacle is reinforced and stiffened with a plurality of protruding cubes 72 and members 74. The addition of these features will ensure that a receptacle made of plastic will have adequate strength for its application as a mail receptacle. The figure also shows a method by which the receptacle 20 may be used to receive and secure articles which are much larger then the receptacle. A length of chain 58 which can be stored inside the receptacle 20 is wrapped around a larger box shaped article 56. The chain 58 is wrapped around the package 56 as if it was being gift wrapped and the chain was the customary ribbon. A padlock 60 which is also normally stored inside the receptacle is then threaded through the links of the chain and used to secure the two free sections of the chain together as closely to the article as possible. Since the chain would be running along all the sides of the article 56, this procedure would prevent the chain from being loosened enough to allow the article 56 to be slipped out. At least one free end of the chain 58 is then threaded onto the "J" shaped member which is then secured inside the receptacle in the manner previously described. This is shown in FIG. 7. The chain may be wrapped around the receptacle itself to augment the lock of the receptacle if a particularly valuable package is received which fits inside the receptacle e.g. a diamond ring.

Figure 8:
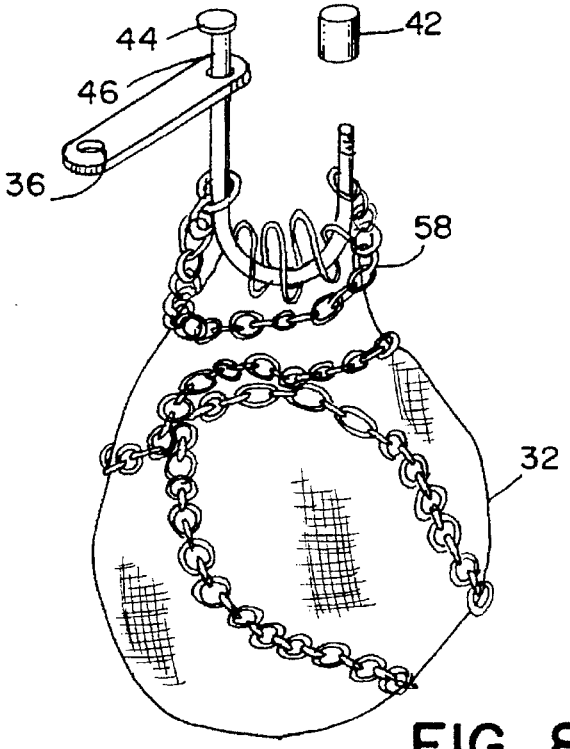
FIG. 8 is a perspective view of a sack, "J" shaped member, and securing chain.

FIG. 8 shows how the chain 58 can be threaded onto the "J" shaped member 34 along with the sack 32 and wrapped around the sack to secure the sack. This will discourage people from ripping the sack open and removing its contents, especially if the contents of the sack would be too big to slip out from the folds of the chain 58. The sack can be made tamper resistant by making it out of Kevlar or a similar strong synthetic material. A sack made of kevlar is very difficult to cut. A sack made of style 1350 kevlar fabric and stitched with kevlar thread has been made. Similarly the sack could be made of synthetic materials from the petrochemical industry which are difficult to cut. These include plastics and nylon. A sack made of Durable nylon and stitched with kevlar thread has been made. The sack, chain and cable are containment means for packages which are not only flexible but are also flaccid. They have the advantage of adapting to the shape of the package to facilitate containment of a package.

Figures 9, 10:
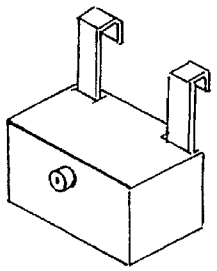
FIG. 9 is a drawing of an address label with the words "combination".
FIG. 10 is an authorization note to a mail carrier.

FIG. 9 shows an address label with a section 72 which is used to record the combination of a package receiving apparatus. The address label is then placed on the exterior of the article to be delivered. The combination may also be written, typed, or otherwise noted anywhere on the exterior of the article to be delivered, or placed in a pouch such that the carrier has access to it at the time he delivers the article. When a package is sent with such an address label, the mail carrier can deposit the package inside the receptacle with the same ease with which letters are deposited in an ordinary mailbox. The combination can also be provided to the carrier by phone or written correspondence.

Figure 11:
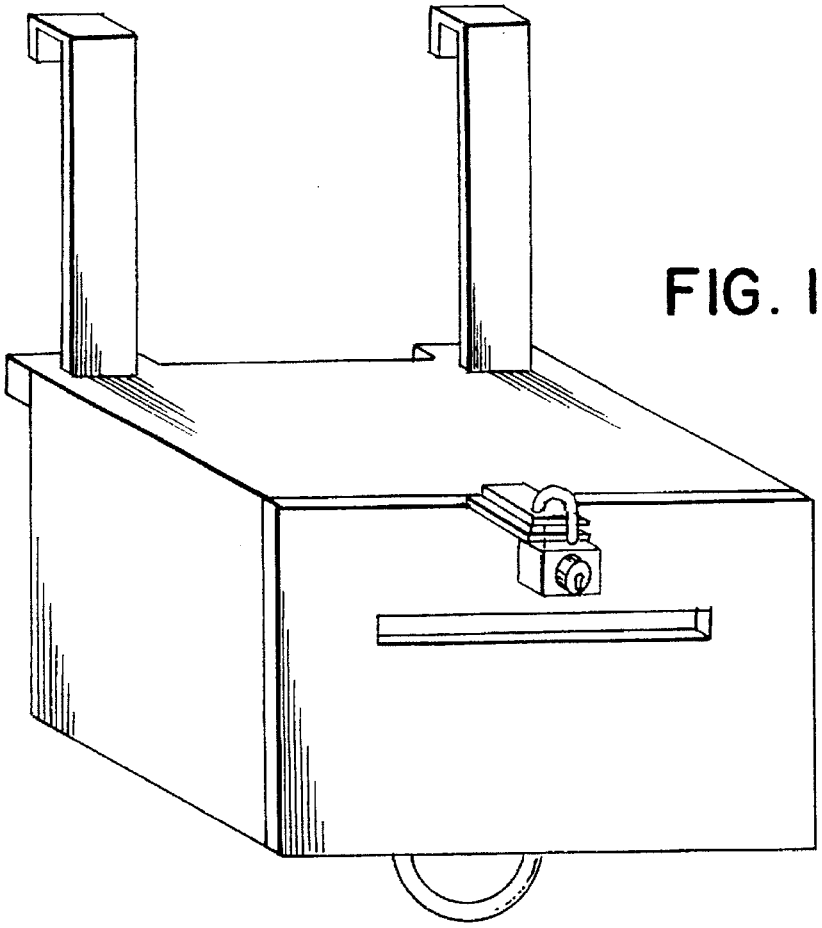
FIG. 11 is a perspective view of a package receiving apparatus which is secured by a padlock.

FIG. 10 shows a form with written instructions to a mail carrier to deposit packages for a particular apartment in the package receiving apparatus hanging from the door of that apartment. The form with glue behind it may be left on the surface of the regular mailbox for the apartment or house or inside the mailbox. The form can also be signed by the addressee and constitute the authority by which the mail carrier may leave packages for which a signature is required. Alternatively the form may indicate the presence of signed papers inside the package receiving apparatus. Possession of such papers by the mailcarrier might be used to indicate that the package was delivered in the specified receptacle as requested by the addressee. The combination or key to the receptacle may also be left inside the regular mailbox for use by the U.S. mail carrier. FIG. 11 shows the package receiving apparatus with the locking mechanism replaced by a padlock 78. Hasps 76 which are attached to the door 28 and to the top of the receptacle 20 are aligned when the door 28 is shut. A padlock 78 can then be threaded into the hasps and locked. The padlock may be of the key operated type, the combination type, or a combination padlock with a key by-pass and it will retain all of the features which the built-in locking unit provided.

Figure 12:
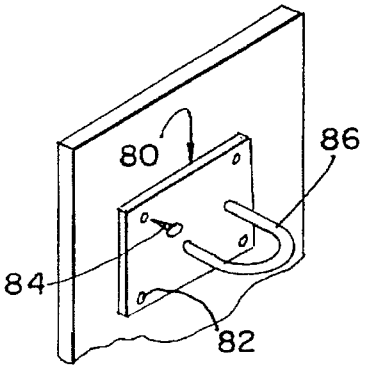
FIG. 12 shows a bracket for fastening the receptacle to a door.
Figure 13:
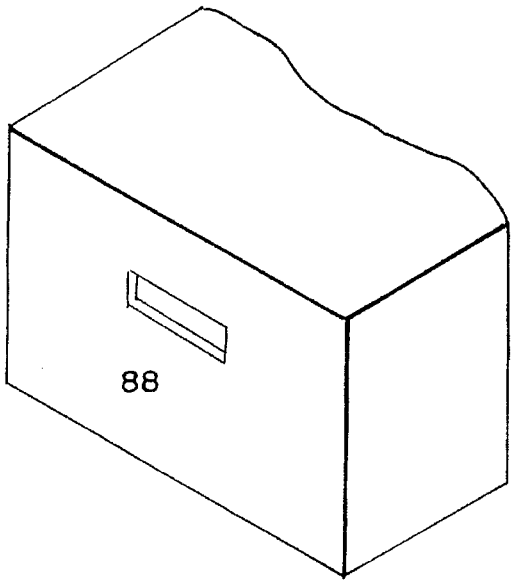
FIG. 13 shows a receptacle with a narrow slot in the rear wall of the receptacle.

FIGS. 12 and 13 show an alternative method of attaching a package receiving apparatus removably to the door of a house or its vicinity.

FIG. 12 shows bracket 80 with a plurality of holes 82 in it fastened to a door by means of screws 84 which pass through the holes 82. A hasp 86 protruding from the bracket 80, and which is integral with the bracket fits into a narrow slot ee in the backwall of the receptacle 20 as shown in FIG. 13. The receptacle is then supported by the hasp 86. Other various attachment means such as clamps, screws, e.t.c. can be used to secure the receptacle, or a bracket for a containment means to a door, a wall near the door, or any suitable object in the vicinity or workplace of the addressee. These attachment means such as the hasp, bracket, e.t.c., constitute mounts for the receptacle which allow it to be securely mounted in the vicinity of the address. For example the bracket of FIG. 12 can also be attached to a wall near the door, or in the vicinity of the address where the package or article is to be delivered.

Figure 14:
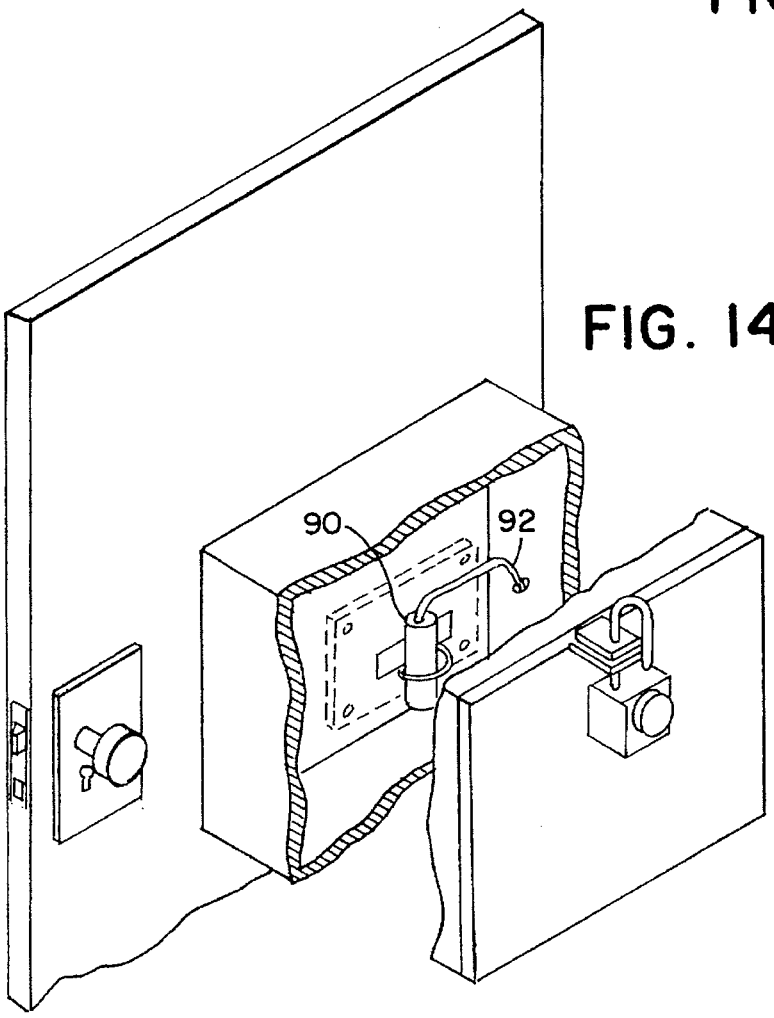
FIG. 14 shows a section view of a package receiving apparatus secured with a bracket to a door.

As shown in FIG. 14, a short tapered bar 90 which is attached by a cable 92 to the receptacle 20 can then be threaded into the hasp 86. The tapered end of the bar 90 is small enough to permit the bar to partially pass through the hole in the hasp 86 until about its middle where the diameter of the bar 90 is too big to allow further movement of the bar. The diameter of the bar 90 where it gets stuck in the hole in the hasp 86 is close to that of the hole in the hasp 86. The bar 90 is threaded into the hole in the hasp 86 so that the smaller tapered end is down facing towards the bottom of the receptacle 20 and the bigger end faces the top of the receptacle. The tight fit between the hole in the hasp 86 and the bar 90 fixes the receptacle rigidly to the hasp so that the hasp 86 is not exposed or visible from the side of the receptacle 20. The bracket 80 is much smaller than the receptacle 20. The slot 88 being centered about the middle of the backwall of the receptacle prevents access to the bracket unless the receptacle 20 is first unlocked and unlatched from the hasp 86.

Figure 15:
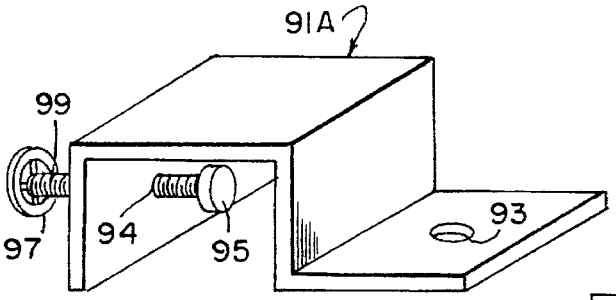
FIG. 15 shows a bracket portion for securing the "J" shaped link to a door.

FIG. 15 shows an adjustable bracket portion 91 which is used for attaching the "J" shaped member to a door. The bracket portion comprises a channel shaped section which has a threaded hole 94 in one wall, through which a threaded shaft 99 passes. The threaded shaft 99 has a handle 97 at one end and a stopper 95 at the other. A hole 93 in a portion of the bracket accommodates the "J" shaped member which is threaded into it.

Figure 17:
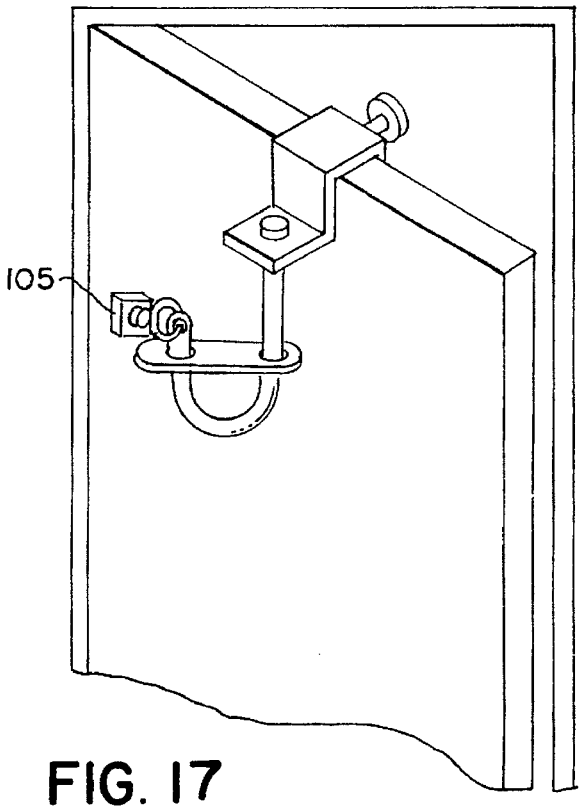
FIG. 17 shows a "J" shaped link attached to a door with a bracket and secured with a padlock.
Figure 16:
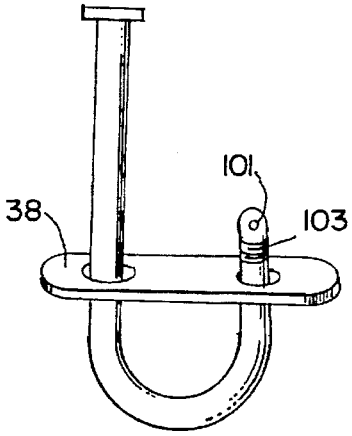
FIG. 16 shows a "J" shaped pivoted link with a hole in one end and a threaded section.

FIG. 16 shows the "J" shaped-member 34 which was described in FIGS. 4 and 5. A threaded section 103 is retained to accommodate the threaded handle 42 described in FIGS. 4 and 5. A hole 101 in the end of the shorter portion 40 of the "J" shaped member 34 is used to secure a padlock to the member when the member is attached to a door directly and not to a receptacle. The use of a padlock threaded through hole 101 would prevent removal of the crossbar of the "J" shaped member 34 in the same manner that the handle 42 did. FIG. 17 shows how the bracket portion 91 is used to secure the "J" shaped member 34 to a door and how the member is secured from opening with a padlock 105. The channel shaped portion of the bracket portion 91 is placed over an edge of an open door so that the handle 97 is on the side of the door inside the room. The flattened portion of the bracket portion with the hole 93 would then be on the side of the door which faces the outside of the room. Thus a first portion of the bracket overlies a first side of the door and a second portion of the bracket overlies a second side of the door. The threaded shaft 99 is turned by means of the handle 97 to advance the stopper 95 against the door. The stopper is advanced so that the bracket portion is securely attached to the door at one of its edges, preferably the top edge. The "J" shaped member 34 is assembled onto the bracket portion 91 by first removing the crossbar 38 from the "J" shaped member 34. This is done by unscrewing the handle 42 from the shorter threaded end 40 of the member 34 and lifting the crossbar 38 vertically upwards until the shorter end 40 of the "J" shaped member slips out of the hole 36 in the crossbar 38. By rotating the crossbar 38 so that the hole 36 in it is away from the shorter end 40 of the "J" shaped member 34, the crossbar is removed from the "J" shaped member by unthreading its second hole 46 from the member 34. The "J" shaped member 34 is then assembled onto the bracket portion 91 by threading the link through the hole 93 in the bracket so that it hangs with is open end facing upwards as shown. The flattened stopper 44 of the member 34 being too big to pass through the hole 93 in the bracket portion 91. The crossbar 38 of the "J" shaped member 34 is then reassembled on the "J" shaped member 34 by reversing the disassembly procedure. The "J" shaped member 34 thus assembled with a bracket portion 91 constitutes a "J" shaped bracket. Instead of the handle 42 to prevent removal of the crossbar 38 from the member 34, a padlock 105 is inserted into the hole 101 in the end of the shorter end 40 of the "J" member 34. A key padlock, a combination padlock, or a combination padlock with a key by-pass may also be used. The "J" shaped member and its assembly components could be made of several materials including metals or plastics. Some types of nylons in particular are very strong and difficult to cut. Also several composites like kevlar are available in industry and are able to replace metals for many applications. Some advantages of using the plastics are reduced cost, a material that will not mar the surfaces of doors, ease of production and the ability to use plastics of different colors.

Figure 18:
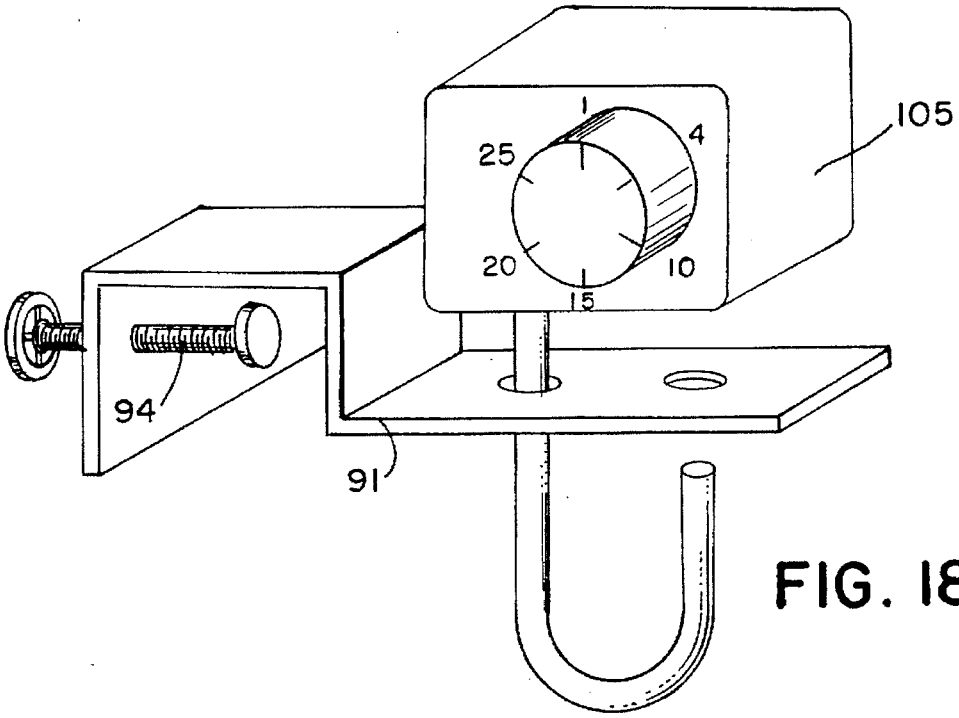
FIG. 18 shows a bracket for attaching a padlock to a door by means of its "J" shaped pivoted link.
Figure 19:
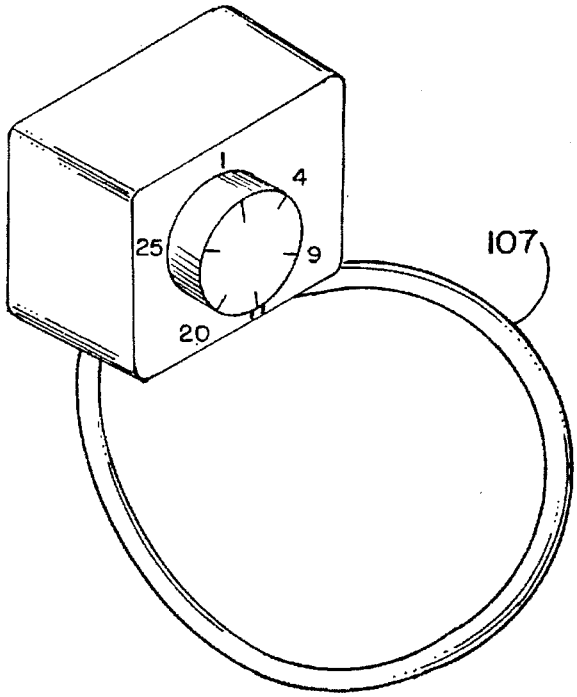
FIG. 19 shows a combination lock with the "J" shaped pivoted link replaced with a flexible cable.

FIG. 18 shows how the "J" shaped member 34 may be replaced with the "J" shaped pivoted link of a padlock. The pivoted link of a padlock is generally "J" shaped and so has the essential feature of the generally "J" shaped bracket. The "J" shaped member and the pivoted link of a padlock are thus functionally the same and can be interchanged. A bracket portion 91A with two holes is provided for attaching a padlock as shown. If the pivoted link of the padlock is big enough it can be used to thread a sack unto, or to close the ends of a chain or other containment means which secures a package. Some padlocks utilize a flexible cable instead of a rigid pivoted link. Such padlocks could also be used in cooperation with the bracket portion to secure a package to a door. FIG. 19 shows such a padlock with a flexible cable 107 replacing the usual pivoted link of the padlock.

Figure 20:
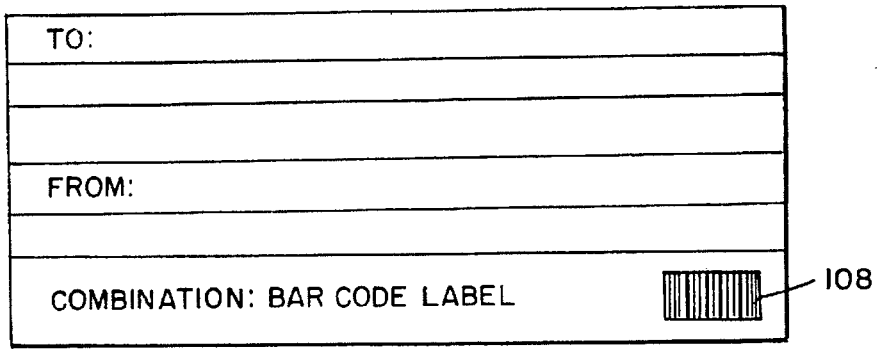
FIG. 20 shows an address label with a barcode label in the combination box.

FIG. 20 shows an address label in which the combination which opens the combination lock has been encoded inside a barcode label 108. The barcode label would normally be put on the package by the mail delivery company after receiving if form the sender of the package or the addressee. The barcode label and the package will them be given to the mailcarrier. Prior to delivering the package the mailcarrier will use a bar code scanner to decode the combination which will show up on an electronic display. The mailcarrier would then use the combination to deliver the package. This method of transmitting the combination further ensures that only the mail delivery company has access to the combination in the event that the package is lost.

Figure 21:
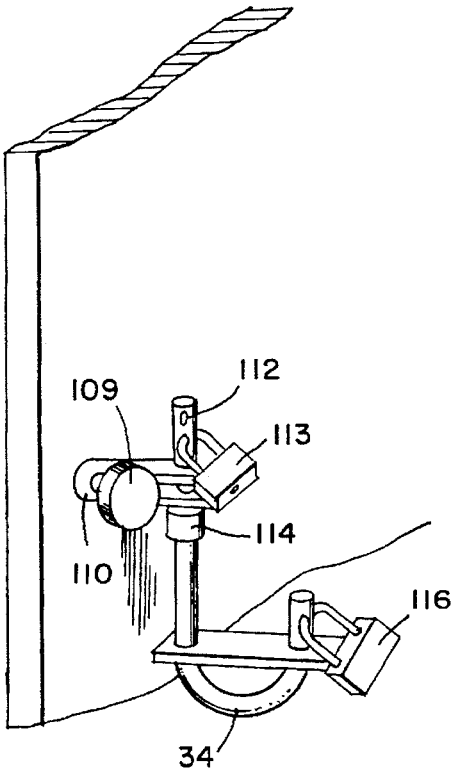
FIG. 21 shows a "J" shaped bracket attached to the handle of a door.
Figure 22:
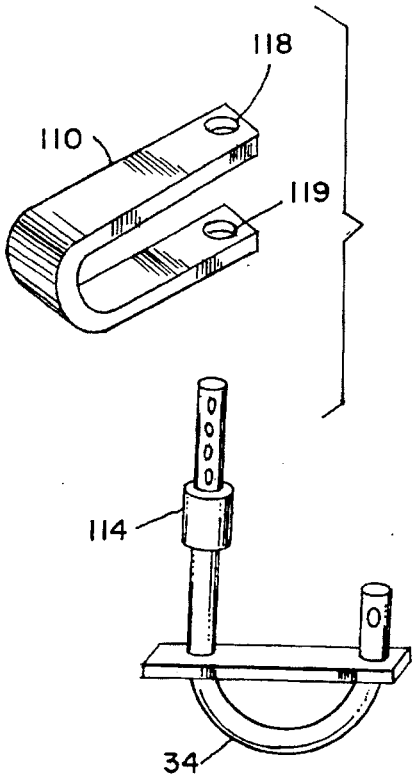
FIG. 22 shows an assembly of a "J" shaped bracket and a locking collar.

FIG. 21 shows the "J" shaped bracket 34 attached to a handle of a door 109. A "U" shaped locking collar 110 is slid unto the narrow stem of a door handle. The narrowness of the locking collar 110 is such that the collar cannot be removed over the wide portion of the handle 109 to which it is connected. The collar can only be removed from the stem of the door handle through its open section. The "J" shaped bracket 34 has a plurality of holes 112 at one end. Below this end, a thicker section 114 of the bracket 34 serves as a stop for the collar 110 when the bracket is assembled with the collar. As shown in FIG. 22 the locking collar has holes 118 and 119. These holes are big enough to allow one end of the "J" shaped bracket to pass through them. The collar would then rest against the thicker section 114 of the bracket 34. A lock 113 is used to prevent removal of collar from the door handle. The lock 113 is threaded through one of the holes 112 which is closest to the collar 110 to prevent removal of the collar and bracket 34 from the door handle. A lock 116 is used to lock a containment means such as a sack, cable, chain, or other receptacle to the bracket 34. In use a person who wishes to receive a package or who expects delivery of one, will provide the sender with the combination to the receptacle by telephone or written correspondence. The sender will send the package with an address label that displays the combination of the receptacle. The addressee will then temporarily deploy the package receiving apparatus on the door of his house until the package is received. If the addressee was not expecting a package and a delivery attempt of a package was made, resulting in a notice being left on the addressee's door, the addressee could deploy the receptacle on his door and telephone the carrier to communicate the combination of the receptacle. Alternatively the addressee could leave the door of the receptacle open, so that the carrier could deposit the package in the receptacle and lock the receptacle afterwards. A package which is too large to fit inside the receptacle can be placed inside a sack which is then attached to the "J" shaped member hanging under the receptacle or attached to the member by means of a chain. Alternatively the addressee could remove the "J" shaped member from the receptacle and attach it to the door directly by means of a bracket portion. A padlock, a sack, or a chain could then be used in combination with the "J" shaped bracket which is formed from the assembly to give many of the same benefits derived from the receptacle. A combination padlock in this case would be preferred. If a large padlock is obtained with a long pivoted link or long cable substituting for the "J" shaped pivoted link common to padlocks, use of the "J" shaped member of the receptacle may be omitted. Instead the padlock would be attached to the door by means of a bracket portion or other attachment means and then used to secure a package to the door or any object in the vicinity of the residence of the addressee. The package could also be delivered to a company or other workplace, or anywhere the packaged is address to in the same way. In all embodiments of the invention, the containment means—receptacle or sack for example, can be used to receive articles C.O.D. The addressee would leave cash, a cheque or money order in the receptacle or sack, close and secure it with the combination lock and deploy the receptacle on the door or near his address as previously described. The mailcarrier delivering the article would remove the money from the containment means and deposit the article inside the containment means as described previously. The addressee could periodically change the combination of the receptacle or combination padlock for security.

Although the present invention has been described with reference to preferred embodiments, those skilled in the art will recognize that changes may be made in form and detail without departing from the spirit and scope of the invention.

I claim:

1. A method of securing an article to a door mounted within a door frame, the method comprising the steps of: providing containment means for surrounding the article; providing securing means for securing the containment means to the door, the securing means comprising receiving means for receiving the containment means and locking means, including a lock, for securing the containment means to the receiving means and for preventing unauthorized removal of the article from the containment means when the containment means is received by the receiving means and secured by the lock;

surrounding the article with the containment means;

manipulating the containment means so as to position the containment means on the receiving means;

employing the lock to secure the containment means to the receiving means, whereby the unauthorized removal of the article is prevented;

wherein the containment means is flexible and comprises a sack having a mouth, wherein the mouth of the sack is secured in a closed condition by the securing means when the containment means is secured to the receiving means by the lock.

2. The method as recited in claim 1 above, wherein the lock is a combination lock.

3. The method as recited in claim 2, wherein each one of the surrounding, manipulating, and employing steps is performed by an article carrier, wherein the method further comprises the step of:

providing the article carrier with a combination to the combination lock.

4. The method as recited in claim 3, wherein, prior to manipulating the flexible containment means, the article carrier further performs the step of:

unlocking the combination lock using the provided combination.

5. The method as recited in claim 2, wherein the employing step comprises:

attaching the combination lock to the receiving means; and locking the combination lock after it has been attached to the receiving means.

6. The method as recited in claim 5, further comprising the steps of:

unlocking the combination lock to remove the flexible containment means from the receiving means; and removing the article from the flexible containment means.

7. The method as recited in claim 3, wherein the step of providing the article carrier with the combination that opens the combination locking means includes placing the combination on the exterior of the article to be delivered.

8. Apparatus comprising:

flexible containment means for surrounding an article;

a bracket which includes retaining means for retaining the flexible containment means, the bracket including a first portion and a second portion;

a door movable between an opened position and a closed position relative to a door frame;

means for removably securing the bracket to the door in such a manner that the first portion of the bracket overlies a first side of the door and the second portion of the bracket overlies a second side of the door;

means for locking the door in the closed position;

means for preventing the removal of the bracket from the door when the door is in its closed condition; and securing means for securing the flexible containment means to the retaining means, wherein the securing means comprises a lock and the flexible containment means comprises a sack.

9. Apparatus as recited in claim 8, wherein the retaining means comprises a J-shaped member.

10. Apparatus as recited in claim 9, wherein the lock is a combination lock.

11. Apparatus as recited in claim 10, wherein the retaining means further comprises a crossbar having a pair of spaced-apart holes, wherein opposite legs of the J-shaped member are received within the spaced-apart holes, and wherein the combination lock is secured to one of the opposite legs of the J-shaped member to prevent removal of the crossbar.

12. Apparatus as recited in claim 10, wherein the combination lock comprises a J-shaped pivoted link, and wherein the J-shaped pivoted link constitutes the retaining means.

13. A method of securing an article to a door mounted within a door frame, the method comprising the steps of:

providing containment means for surrounding the article;

providing securing means for securing the containment means to the door, the securing means comprising receiving means for receiving the containment means and a combination lock for securing the containment means to the receiving means;

surrounding the article with the containment means;

manipulating the containment means so as to position the containment means on the receiving means;

employing the combination lock to secure the containment means to the receiving means, whereby unauthorized removal of the article is prevented;

further comprising the steps of:

opening the door;

securing a bracket to the open door in such a manner that a first portion of the bracket overlies a first side of the door and a second portion of the bracket overlies a second side of the door;

closing the door so as to secure the bracket between the door and the door frame; wherein the securing means is integral with the bracket and the containment means is secured to the bracket;

wherein the containment means is flexible;

wherein each one of the surrounding, manipulating, and employing steps is performed by an article carrier, wherein the method further comprises the step of providing the article carrier with a combination to the combination lock; and wherein the step of providing the article carrier with the combination that opens the combination locking means includes placing an indication of the combination on the exterior of the article to be delivered.

14. A method for insuring safe delivery and receipt of a package at an address comprising the steps of:

providing a combination lock retaining member in a vicinity of the address;

retaining a combination lock on the combination lock retaining member;

providing a containment means for receiving the package;

interconnecting a locking member of the combination lock with the containment means in such a manner that the locking member is effective to hold the containment means in a closed condition in which the containment means substantially surrounds the package;

locking the combination lock; and providing a package carrier with a combination to the combination lock;

wherein upon delivery, the package carrier performs the steps of:

unlocking the combination lock;

opening the containment means;

depositing the package within the containment means;

closing the containment means; and relocking the combination lock so as to secure the package within the containment means, thereby preventing unauthorized removal of the package from the containment means;

wherein the step of providing the package carrier with the combination includes:

reproducing the combination in perceptible form and providing the carrier with a reproduction of the combination.

15. The method as recited in claim 14 above, wherein the step of providing the carrier with a reproduction of the combination includes the step of:

visually indicating the combination on an exterior surface of the package being delivered.

16. The method as recited in claim 15 above, wherein the containment means comprises a receptacle adapted to receive packages, the receptacle including a door portion which is movable between a first position where the door portion substantially covers an opening of the receptacle and a second position where the opening of the receptacle remains substantially uncovered, and wherein the steps of opening and closing the containment means include moving the door portion from the first position to the second position and from the second position to the first position, respectively.

17. The method as recited in claim 15 above, wherein the containment means is flaccid.

18. The method as recited in claim 17 above, wherein the containment means comprises a sack, and the steps of opening and closing the container include opening and closing a mouth of the sack.

19. The method as recited in claim 14 above, wherein the step of providing the carrier with a reproduction of the combination includes using a telephone to transmit the combination to the carrier.

20. Apparatus, comprising:

a door movable between an opened position and a closed position relative to a door frame;

means for locking the door in the closed position;

a bracket attached to the door for removably securing a sack to the door in such a manner that a mouth of the sack is closed by the bracket when the sack is secured to the bracket; and sack locking means for selectively locking the sack to the bracket in such a manner that an article within the sack may be secured therein by the sack locking means;

wherein the sack locking means comprises a lock which is lockable by an article carrier after the article has been deposited within the sack.

21. Apparatus as recited in claim 20 above, wherein the bracket is generally "J" shaped.

22. Apparatus as recited in claim 21 above, wherein the mouth of the sack includes a perimeter provided with plurality of holes therein and the bracket is threaded through the holes in the perimeter of the mouth to close the sack.

23. Apparatus as recited in claim 20, wherein the bracket is attached to a handle of the door.

24. Apparatus as in claim 23 above, wherein the bracket is attached to the handle by means of a generally "U" shaped locking member; and wherein the handle is attached to the door by a thin portion and has a wider portion at its unattached end; and wherein the "U" shaped locking member is adapted to substantially enclose the thin portion of the handle where it attaches to the door through an open section, whereby removal of the "U" shaped locking member from the handle is possible only through the open section of the "U" shaped locking member; and wherein the "U" shaped locking member is adapted to form a closure of its open section in cooperation with the bracket, the apparatus further comprising;

locking means for locking the bracket to the "U" shaped locking member, whereby unauthorized separation of the bracket from the "U" shaped locking member is prevented.

25. A method for insuring safe delivery and receipt of a package at an address comprising the steps of:

a) providing a combination lock retaining member in a vicinity of the address;

b) retaining a combination lock on the combination lock retaining member;

c) interconnecting an open locking member of the combination lock and a containment means for receiving the package in such a manner that the locking member is effective to hold the containment means in a closed condition in which the containment means substantially surrounds the package;

d) locking the combination lock; and c) providing a package carrier with a combination to the combination lock;

wherein upon delivery, the package carrier performs the steps of:

d) unlocking the combination lock;

e) opening the containment means;

f) depositing the package within the containment means;

g) closing the containment means; and h) relocking the combination lock so as to secure the package within the containment means, thereby preventing unauthorized removal of the package from the containment means;

wherein the step of providing the package carrier with the combination includes:

electromagnetically transmitting the combination to the package carrier.

26. A method for insuring the safe delivery and receipt of packages at an occupant's address comprising the steps of:

a) employing means for installing a combination locking member in a secure fashion in the vicinity of the occupant's address; wherein, the combination locking member is provided with a generally J-shaped pivoted link adapted to form a closure in cooperation with the combination locking member;

b) attaching a containment means to said combination locking member, wherein the containment means comprises a sack; and, c) providing package carrier with the combination to said combination locking member so that the pivoted link can be partially disengaged from said combination locking member to allow the containment means to receive a package; and, d) re-engaging the pivoted link with the combination lock member to close the combination lock;

e ) wherein the sack includes a plurality of holes along a perimeter of an opening, and wherein the method further comprises the step of:

threading the generally J-shaped pivoted link through the holes.

27. A method for insuring the safe delivery and receipt of packages at an occupant's address comprising the steps of:

a) employing means for installing a combination locking member in a secure fashion in the vicinity of the occupant's address; wherein, the combination locking member is provided with a generally J-shaped pivoted link adapted to form a closure in cooperation with the combination locking member;

b) attaching a containment means to said combination locking member, wherein the containment means comprises a sack; and, c) providing package carrier with the combination to said combination locking member so that the pivoted link can be partially disengaged from said combination locking member to allow the containment means to receive a package; and, d) re-engaging the pivoted link with the combination lock member to close the combination lock;

e) wherein the step of providing the package carrier with the combination includes using a telephone to provide the carrier with the combination.

* * * * *